US005909740A

United States Patent [19]

Sussman

[11] Patent Number: 5,909,740

[45] Date of Patent: Jun. 8, 1999

[54] PROTECTIVE CAP AND MIRROR UNIT FOR COSMETIC PENCIL

[76] Inventor: Morris Sussman, 50 Doxsee Dr., Freeport, N.Y. 11520

[21] Appl. No.: 09/137,284

[22] Filed: Aug. 20, 1998

[51] Int. Cl.[6] ..... A45D 40/24

[52] U.S. Cl. ..... 132/318; 132/316; 132/317; 401/195

[58] Field of Search ..... 132/318, 316, 132/315, 317, 218, 320; 401/52, 98, 195; 206/385

[56] References Cited

U.S. PATENT DOCUMENTS

| | | | |
|---|---|---|---|
| D. 96,886 | 9/1935 | Ball | 132/318 |
| D. 144,145 | 3/1946 | Silson | 132/318 |
| 2,074,378 | 3/1937 | Elkins | 132/318 |
| 2,513,046 | 6/1950 | Pellard | 132/318 |
| 2,804,082 | 8/1957 | Dewing | 132/318 |
| 4,506,716 | 3/1985 | Hayashi | 145/3.5 |
| 4,600,328 | 7/1986 | Clements | 132/218 |
| 4,987,911 | 1/1991 | Powers | 132/218 |
| 5,174,310 | 12/1992 | Galbraith et al. | 132/316 |
| 5,178,478 | 1/1993 | Ryder | 401/195 |

*Primary Examiner*—Gene Mancene
*Assistant Examiner*—Pedro Philogene
*Attorney, Agent, or Firm*—Michael Ebert

[57] ABSTRACT

A protective cap and mirror unit for a cosmetic pencil having a sharpened tip. The unit is molded of plastic to define a small rectangular frame whose rear face is integral with a tubular cap, the entry of which is at the lower end of the frame, a mirror being mounted on the front face of the frame. In the storage mode of the unit, the tip end of the cosmetic pencil is snugly telescoped in the cap. In an active mode, a user holding the pencil in one hand and grasping the unit with the other hand, withdraws the unit from the pencil and then defines with the cosmetic pencil her lips or eyes as she observes at close range her face in the mirror.

5 Claims, 1 Drawing Sheet

PROTECTIVE CAP AND MIRROR UNIT FOR COSMETIC PENCIL

BACKGROUND OF INVENTION

1. Field of Invention

This invention relates generally to cosmetic pencils, and more particularly to a protective cap and mirror unit for a cosmetic pencil which makes it possible for a user to see her face at close range as she defines her lips or eyes with the pencil.

2. Status of Prior Art

A conventional pencil for writing or drawing consists of a cylinder of wood encasing a thin rod of graphite or colored wax. A cosmetic pencil, which is used by a woman to outline her lips or eyes, is similar to a conventional pencil except that its central rod is thicker and is formed of a soft cosmetic substance whose composition and color are appropriate to the intended use of the pencil.

Both a conventional pencil and a cosmetic pencil require sharpening to bring the conical tip of the pencil to a point, and to renew this point when blunted by use. A cosmetic pencil is normally provided with a removable protective cap covering the tip end of the pencil.

A woman away from home usually takes along one or more cosmetic pencils, a pencil sharpener and a small mirror, putting these items in her purse or in a vanity case. When the woman has occasion to use a cosmetic pencil, as for example in the restroom of a restaurant, she is then able to observe her face in the small mirror as she draws cosmetic lines outlining her eyes or lips.

The reason it is difficult for the women to use the large mirror normally found in a restaurant restroom is that she cannot in a large mirror installed behind a sink or counter observe her face at close range so as to be able to clearly see the lines being drawn by the cosmetic pencil. For this purpose a small hand-held mirror is more suitable, for a woman grasping this small mirror in one hand close to her face can with her other hand holding the cosmetic pencil accurately draw the cosmetic lines to define her eyes or lips.

The cosmetic rod of a cosmetic pencil is relatively soft and after to use to define the eyes or lips, the pencil must these be resharpened. For this purpose small cosmetic pencil sharpeners are available are similar to a writing pencil sharpener and include an angled blade to engage the tip of the pencil.

Of prior art interest is the 1998 patent to Conley Jr. U.S. Pat. No. 5,715,848 which discloses a cosmetic system provided with a small mirror integrated with a cylindrical housing which accommodates lip and eye cosmetic pencils as well as a lipstick. The housing also incorporates in its structure a pencil sharpener. But the Conley Jr. system does not provide a protective cap for cosmetic pencils, for these pencils are fully inserted within the cylindrical housing.

A conventional protective cap for a cosmetic pencil is often misplaced, for when a woman withdraws this cap from the pencil in order to put the pencil to use, the cap is then laid down on a table or other available surface. When the woman later wishes to recap the cosmetic pencil, she may not remember where she laid the cap down, and be unable to recover it.

SUMMARY OF INVENTION

In view of the foregoing, the main object of this invention is to provide a cap and mirror unit for a cosmetic pencil having a sharpened tip, the unit serving not only to protectively cap the tip end of the pencil and thereby isolate the tip, but also to make available to the user of the pencil a small mirror.

More particularly, an object of the invention is to provide a unit of the above type in which the small mirror is integrated with the protective cap to create a unitary assembly.

A significant advantage of the invention is that the user using the unit has no occasion to lay it down on a table or on some other surface, for when the woman with one hand grasping the unit removes it from the pencil held in her other hand, the woman then uses the unit in order to observe her face as she defines her lips or eyes with the pencil. And upon completing this task, the woman recaps the pencil with the unit.

Also an object of the invention is to provide a unit of the above type that includes in combination with a mirror twin caps for protecting a pair of cosmetic pencils.

Yet another object of this invention is to provide a unit of the above type that includes in combination with a mirror, a protective cap for a cosmetic pencil and a sharpener for the pencil.

Briefly stated, these objects are attained by a protective cap and mirror unit for a cosmetic pencil having a sharpened tip. The unit is molded of plastic to define a small rectangular frame whose rear face is integral with a tubular cap, the entry of which is at the lower end of the frame, a mirror being mounted on the front face of the frame.

In the storage mode of the unit, the tip end of the cosmetic pencil is snugly telescoped in the cap. In an active mode, a user holding the pencil in one hand and grasping the unit with the other hand, withdraws the unit from the pencil and then defines with the cosmetic pencil her lips or eyes as she observes her face in the mirror.

BRIEF DESCRIPTION OF DRAWINGS

For a better understanding of the invention, as well as other objects and features thereof, reference is made to the accompanying drawings wherein.

DESCRIPTION OF DRAWING

Prior Art

Figure 1:
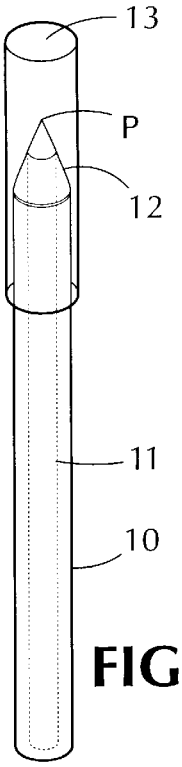
FIG. 1 shows a cosmetic pencil with a conventional protective cap.

A conventional cosmetic pencil 10, as shown in FIG. 1, is formed by a cylinder of wood encasing a rod 11 of a cosmetic substance appropriate to the use for which the pencil is intended. Thus a pencil for defining the lips has a rod whose substance and color differ from those of a rod for defining the eyes.

The conventional cosmetic pencil has a sharpened conical tip 12 which brings the cosmetic rod 11 to a point P. It is therefore necessary to protect this point and for this purpose the conventional practice is to provide the pencil with a protective cylindrical cap 13 of a plastic material that may be transparent so that one can see the point and its color. The tip end of the pencil, as shown in FIG. 1, is snugly telescoped in the cap, and to remove the cap, it must be pulled off the pencil.

As previously explained, in order for a user to accurately define her lips or eyes with a cosmetic pencil, she must see her face at close range, and this is best done with a small hand-held mirror. But whether the user has available a small mirror or uses a large mirror, she must first uncap the pencil and place cap 12 on a table or counter as she makes use of the pencil.

Cap 12 is quite small, being about an inch and a half in length and one quarter of an inch in diameter. What occurs all too often is that after cap 12 is taken off the pencil and put down so that the user can then put the cosmetic pencil to use, when the user has completed her task and wishes to recap the pencil, she cannot remember where she placed the cap. And if the pencil remains uncapped and is stored in a handbag or purse, it may then soil the purse.

First Embodiment

Figure 2:
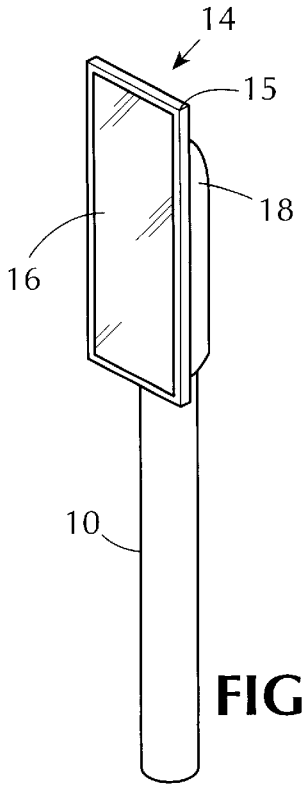
FIG. 2 shows the same pencil but in association with a protective cap and mirror unit in accordance with the invention, as seen from the mirror side of the unit.
Figure 3:
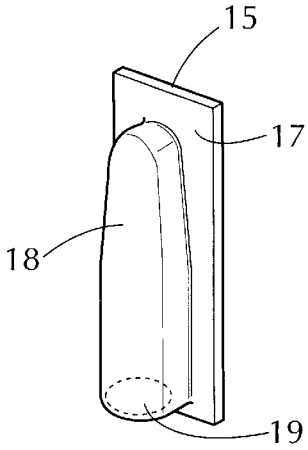
FIG. 3 shows the rear side of the same unit.

In a protective cap and mirror unit, as shown in FIGS. 2 and 3, unit 14 is molded of synthetic plastic material, such as polypropylene or polyethylene, to form a small rectangular frame 15 having a bordered front face in which is inset a rectangular mirror 16.

Integral with the rear face 17 of frame 15 is a tubular cap 18 whose entry 19 is adjacent the lower end of the frame. Thus when in a storage mode, the tip end of the cosmetic pencil is snugly telescoped in cap 18, as shown in FIG. 2, unit 14 is then mounted on pencil 10. Because the unit is not much bulkier than a conventional protective cap, the capped pencil may be conveniently stored in a purse or vanity case.

FIG. 2 shows unit 14 in its storage mode in which it protectively shields the soft cosmetic tip of pencil 10, in which mode the pencil may safely be put in a purse or handbag without soiling the bag.

In the active mode, when a woman wishes to define her lips or eyes with cosmetic pencil 10, then she holds pencil 10 in one hand and grasps and pulls off unit 14 with her other hand. She then raises unit 14 close to her face so that she can look into mirror 16 and see her lips or eyes as she defines them with lines drawn by pencil 10.

At no time is unit 14 placed on a table or elsewhere, for when the pencil is being used, unit 14 is then held in one hand of the user, and when the user has finished using the pencil, it is recapped by the unit.

Second Embodiment

Figure 4:
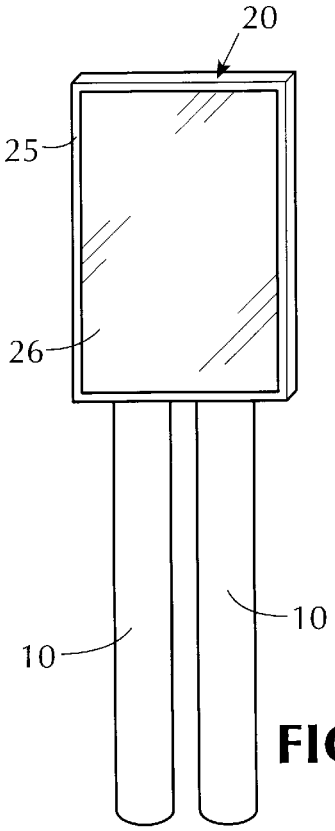
FIG. 4 shows a unit in accordance with the invention in which a mirror is combined with twin protective caps, as seen from the mirror side.
Figure 5:
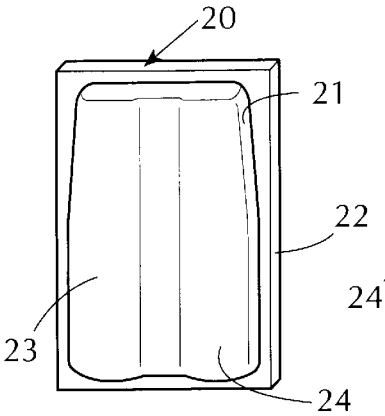
FIG. 5 is a rear view of the unit shown in FIG. 4.

In the embodiment of unit 20 shown in FIGS. 4 and 5, the unit is designed to cap a pair of cosmetic pencils 10. To this end the rear face 21 of a molded rectangular frame 22 has integrated therewith twin tubular caps 23 and 24 in parallel relation for capping the tip ends of the cosmetic pencils. The bordered front face 25 of frame 22 has a rectangular mirror 26 inset therein.

The advantage of this unit is that it caps a pair of cosmetic pencils, one being a pencil for the lips, and the other a pencil for the eyes and therefore having a different cosmetic.

Third Embodiment

Figure 6:
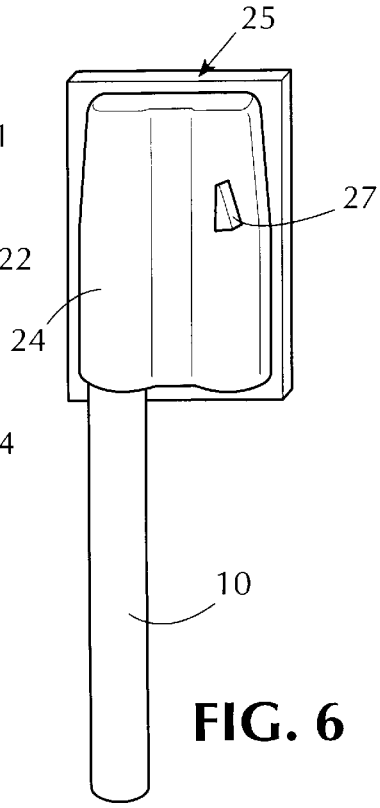
FIG. 6 shows a unit in accordance with the invention in which a mirror is combined with a protective cap for a cosmetic pencil and a sharpener therefor.

The embodiment of a unit 25 which is shown in FIG. 6 is similar to that shown in FIG. 5 except that instead of twin caps for a pair of cosmetic pencils, it has a single cap 26 for a cosmetic pencil 10 and an adjacent pencil sharpener 27 having an internal blade. The dimensions of sharpener 27 are similar to those of cap 26, for the sharpener is adapted to receive and sharpen the tip of cosmetic pencil 10 whose tip end is inserted in cap 26.

In this embodiment, a small mirror (not shown), is mounted on the front face of the frame, cap 26 and sharpener 27 being integrated with the rear face of the frame.

The advantage of the unit shown in FIG. 6 is that after cosmetic pencil 10 is put to use and its point blunted, before it is recapped, the tip of the pencil may be resharpened in sharpener 27. Hence the pencil is in condition to be reused.

While there has been shown and described preferred embodiments of a protective cap and mirror unit for cosmetic pencil in accordance with the invention, it will be appreciated that many changes may be made thereon without departing from the spirit of the invention.

I claim:

1. A protective cap and mirror unit for a cosmetic pencil provided at one end with a sharpened tip for drawing cosmetic lines to define the eyes or lips of a user of the pencil, said unit comprising:

A. a rectangular frame molded of synthetic plastic material having a front face and a rear face;

B. a molded tubular plastic cap integral with the rear face of the frame having an entry adjacent one end of the frame to receive and protect the tip end of the cosmetic pencil; and C. and a mirror mounted on the front face of the frame, said unit having a storage mode in which the tip end of the pencil is snugly telescoped in the cap and shielded thereby, and in active mode in which the unit is held in one hand of the user as she observes her face at close range in the mirror while holding the pencil in her other hand to draw said lines.

2. A unit as set forth in claim 1, in which the frame and cap are molded of polypropylene.

3. A unit as set forth in claim 1, in which the front face of the frame has a rectangular border in which the mirror is inset.

4. A unit as set forth in claim 1, in which integral with the rear face is a pair of tubular caps to cap a pair of pencils.

5. A unit as set forth in claim 1, in which integral with the rear face of the frame and parallel to the tubular cap is a tubular pencil sharpener.

* * * * *